United States Patent [19]

Romick

[11] 4,418,823

[45] Dec. 6, 1983

[54] MEDICATION HANDLING SYSTEM AND REUSABLE DISPENSING CONTAINER

[76] Inventor: Jerome M. Romick, 5191 Etna Rd., Columbus, Ohio 43213

[21] Appl. No.: 240,266

[22] Filed: Mar. 4, 1981

[51] Int. Cl.[3] ..... B65D 69/00; B65D 83/00

[52] U.S. Cl. ..... 206/538; 206/459; 206/540; 220/22

[58] Field of Search ..... 206/538, 540, 534; 220/22.1, 22.3, 22.2, 22.5, 22; 221/4, 5; 229/15, 40, 42

[56] References Cited

U.S. PATENT DOCUMENTS

| | | | |
|---|---|---|---|
| 655,530 | 8/1900 | Vossbeck | 220/22.3 |
| 1,126,103 | 1/1915 | Sheridan | 229/42 |
| 1,799,656 | 4/1931 | Tinsley | 229/15 |
| 2,013,051 | 9/1935 | Hermani | 206/538 |
| 2,081,078 | 5/1937 | Watson | 220/22.3 |
| 3,497,982 | 3/1970 | Schulz | 206/459 |
| 3,826,222 | 7/1974 | Romick | 206/534 |
| 3,833,143 | 9/1974 | Starkerman et al. | 206/538 |
| 3,884,349 | 5/1975 | Charles | 229/40 |
| 4,163,496 | 8/1979 | Dogliotti | 206/538 |
| 4,221,320 | 9/1980 | Faller | 229/40 |

*Primary Examiner*—William T. Dixson, Jr.
*Assistant Examiner*—Jimmy G. Foster
*Attorney, Agent, or Firm*—Wood, Herron & Evans

[57] ABSTRACT

A reusable loose dose medication dispensing container is provided which includes a main compartment and a reserve compartment. In its preferred form a removeable cardboard band is placed around the container. The band is provided with color coded information assisting in the dispensing of the medication.

3 Claims, 6 Drawing Figures

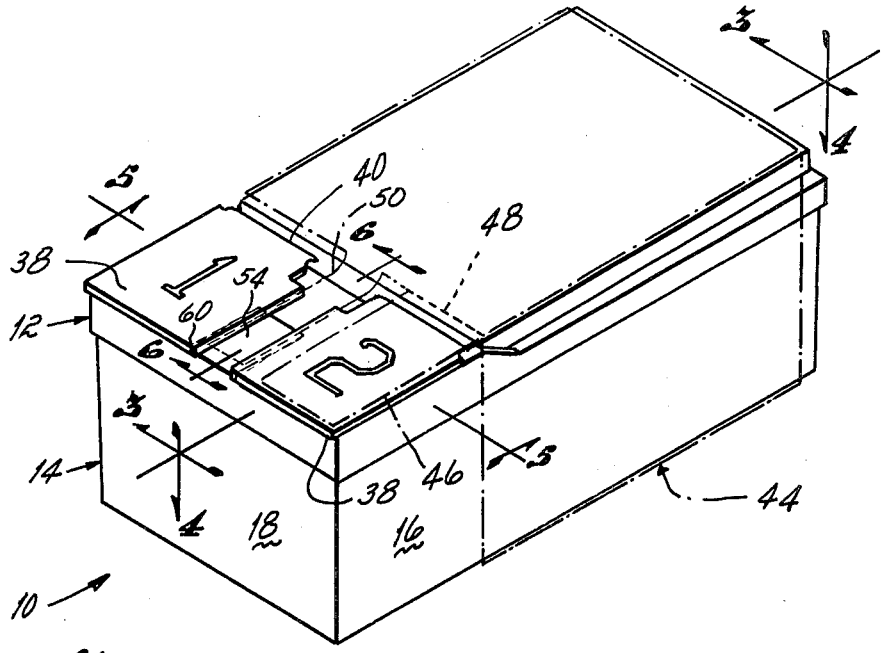
Fig. 1
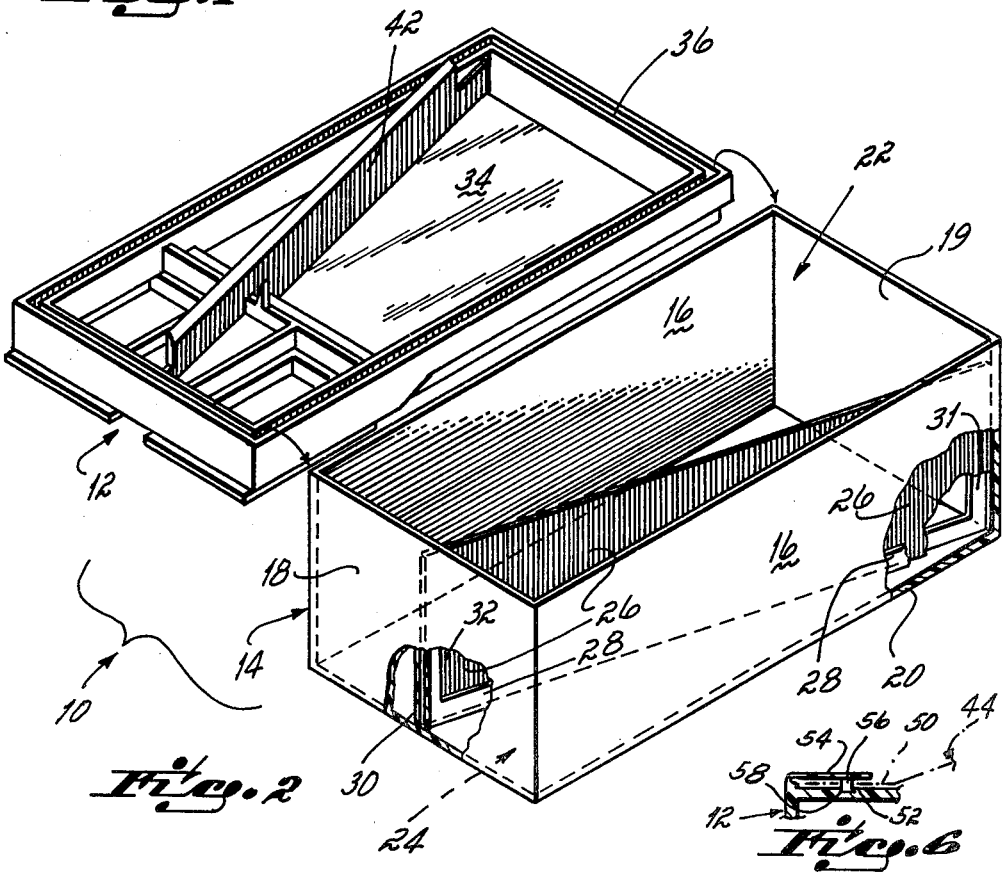
Fig. 2
Fig. 6

MEDICATION HANDLING SYSTEM AND REUSABLE DISPENSING CONTAINER

BACKGROUND OF THE INVENTION

In my U.S. Pat. No. 3,826,222, incorporated by reference herein, I described a system for dispensing unit doses of medication in small strip packs which are placed in a rectangular dispensing box. The box has printed matter at one end including certain color coded indicia which indicate various conditions for administering the unit doses. A label is provided for adherence to the color coded section on the box and has code selecting areas thereon which correspond to the color coded areas printed on the box. By properly punching the label in the code selected areas corresponding to the color coded areas on the box the desired color codes on the box will be exposed. These exposed color codes quickly visually indicate to the nurse the time for administering the proper doses and other factors which should be called to the attention of the nurse. This system was especially adapted to unit doses in strip pack form. However, the patent does disclose that other forms such as vials, capsules, envelopes, and the like could be employed.

While the above described system has been especially useful where unit dose strip packs are employed and where the dispensing containers are rectangular boxes of the throwaway type, there still exists a need for a reusable dispensing container where the medication is included in the container in loose form. Moreover, there has existed a need for such a dispensing system which incorporates in the system safeguards to insure that the medication is dispensed in an efficient and safe manner and where provisions are included in the system to insure that a sufficient supply of medication is on hand at all times. More particularly, there is a need to insure that a nurse may quickly and easily determine when medication must be reordered and a need to insure that a reserve supply of the medication is on hand while the prescription is being refilled. Furthermore, there exists a need for such a system where the specific dispensing instructions are easily apparent to the nurse.

SUMMARY OF THE INVENTION

I have found that the foregoing needs may be fulfilled through the use of a loose dose dispensing container, preferably made from a plastic such as polypropylene, which includes at least two compartments. One compartment, a reserve compartment, is designed to contain a sufficient supply of the medication so as to fulfill the medical requirements of the patient while the prescription is being refilled. The other compartment is adapted to contain the bulk of the supply of the medication. When this main compartment is emptied then the nurse dispenses from the smaller or reserve supply compartment. The top of the loose dose dispensing container contains two dispensing spouts, one which is connected to the reserve supply chamber and the other to the larger chamber. In practice the nurse dispenses from the large chamber through the shaker spout connected thereto and when that supply is exhausted the medication is dispensed from the reserve chamber through the shaker spout cooperating with that chamber. A cardboard band is placed around the container and is slidably removable therefrom. The band is provided with printed indicia including color coding sections as disclosed in my U.S. Pat. No. 3,826,222. Labels of the type shown in the patent are provided which overlay the color coded sections on the cardboard band.

DESCRIPTION OF THE DRAWINGS

FIG. 1 is a perspective view illustrating my reusable loose dose medication dispenser;

FIG. 2 is a perspective view illustrating my reusable loose dose medication dispenser with the top removed;

FIG. 6 is a cross-sectional drawing taken along lines 6—6 of FIG. 1.

DETAILED DESCRIPTION

Figure 3:
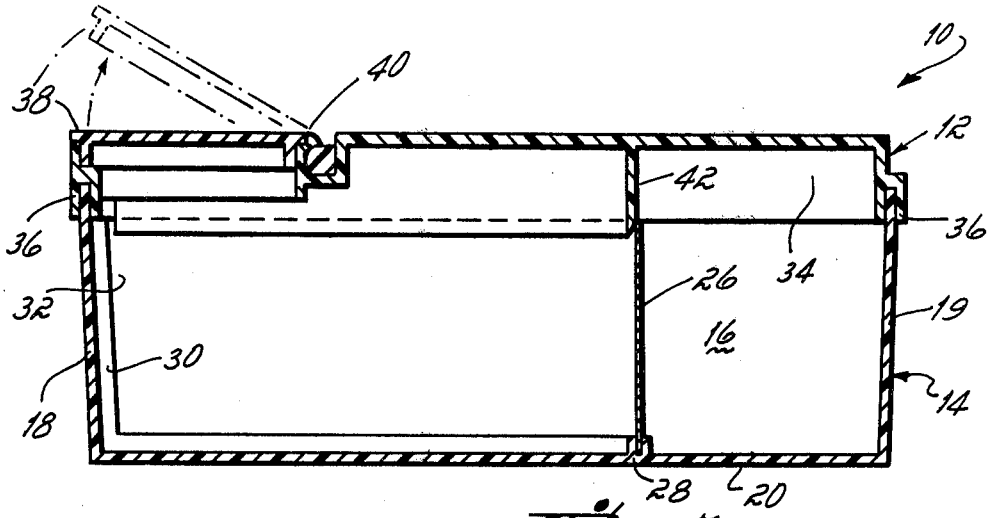
FIG. 3 is a cross-sectional drawing taken along lines 3—3 of FIG. 1.
Figure 4:
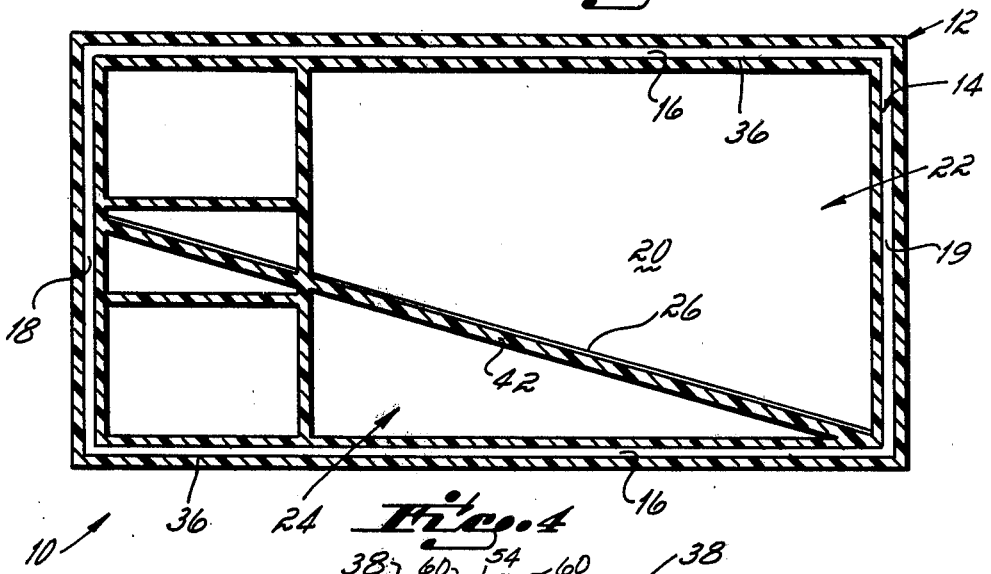
FIG. 4 is a cross-sectional drawing taken along lines 4—4 of FIG. 1.

In my U.S. Pat. No. 3,826,222 I have described a medication dispensing cart which contains trays into which the medication dispensing containers are inserted. This type of medication dispensing system is especially adapted for use with the reusable loose pack dispensing containers of the present invention.

Referring to FIG. 1 and FIG. 2, a loose dose dispenser 10 is illustrated. The top 12 of the loose dose dispenser 10 is removable for facilitating the filling of the loose dose dispenser 10 with medication. The bottom portion 14 includes sidewalls 16, a front endwall 18, a rear endwall 19 and a bottom 20. Preferably the top 12 and the bottom portion 14 are injection molded from polypropylene plastic. FDA approved material insures that the reusable loose dose dispenser 10 complies with applicable statutory requirements.

Figure 5:
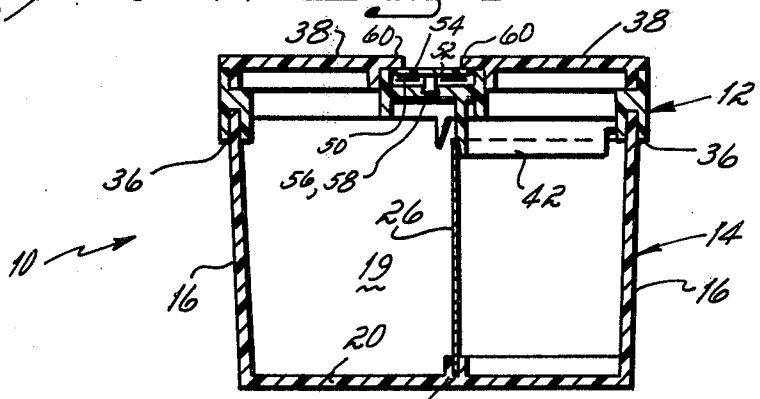
FIG. 5 is a cross-sectional drawing taken along lines 5—5 of FIG. 1.

Referring to FIG. 2, the bottom portion 14 is divided into two compartments, a large compartment 22 and a smaller reserve compartment 24. The bottom portion is divided into these two compartments by means of a removable cardboard divider 26. As best seen in FIG. 2 the height of this cardboard divider 26 when inserted is slightly less than the height of the sidewalls 16 and endwalls 18. The removable cardboard divider is received by a channel 28 which is best seen in FIG. 5. This channel 28 extends from a corner of the bottom portion 14 adjacent to rear endwall 19 and a sidewall 16 to a point about midway in the front endwall 18. The bottom channel 28 joins a vertical channel 30 in the front endwall 18. This channel 30 receives end 32 of the cardboard divider. The rear endwall 19 has a channel which is formed as a vertical channel which is formed by the sidewall 16 and a vertical flange 31. It also joins the channel 28 and receives an end of the cardboard divider 32. In normal use, a small plastic bag, not shown, is positioned in the bottom 14 before the divider 26 is inserted. This facilitates cleaning and reuse of the dispenser 10.

The top 12 for the loose dose dispenser 10 has at its bottom surface 34 a circumferential channel 36 which surrounds the bottom surface 34. This channel receives the tops of the sidewalls 16 and endwalls 18 and 19 to provide a sure airtight fit. As best seen in FIG. 1 the top 12 contains two pill dispensing flaps 38 which are hinged at their rear 40 to the top 12. As seen in FIG. 3 the flaps may be raised upwardly when the top 12 is placed in engagement with the bottom portion 14. The opening thus formed when the flaps are raised enables one to remove pills from the compartments 22 or 24 of the loose dose dispenser 10. As shown in FIG. 2 the bottom surface 34 of the top 12 contains a vertical depending flange 42 which will lie close to the divider 32 when the top 12 is inserted onto the bottom portion 14 so this will prevent any pills from being transferred unintentionally from one compartment to the other.

As shown in FIG. 1 by the phantom lines a rectangular band is provided which may be slipped onto the loose dose dispenser. Preferably this rectangular band 44 is made from paperboard. It may include a portion 46 which overlies the dispensing flap numbered 2. This flap may be separated from the large area of the band by a score line 48 which enables the flap to be easily torn off and removed. In practice the band 44 will have color coded indicia printed on it which will assist the nurse in dispensing the medication at the proper time, etc. The printed mater referred to is the same type as is shown in my earlier patent discussed above. In addition, labels, not shown, which cooperate with such printed matter may be of the type shown in my patent and illustrated in FIG. 5 thereof.

Referring to FIGS. 1 and 6, there is provided a means for securing the paperboard band 44 to the dispenser 10 comprising a locking tongue 50, having a hole 52 therethrough, a locking tab 54 connected to and integral with the top 12 and having a projection 56 that is engageable with a hole 58 formed in the top 12. The hole 52 on locking tongue 50 is positioned so that when the paperboard band 44 is in position on the dispenser 10 it lies immediately above hole 58. The projection 56 is formed on the locking tab 54 in a position so that when tab 54 is closed, as shown in FIG. 6, the projection 56 extends through hole 52 and into hole 58. In this manner paperboard band 44 cannot be removed from the dispenser 10. As an added safety precaution if either flap 36 or 38 is in the closed position the inside edges 60 will overlie the locking tab 54 so that it could be raised upwardly and thus permit the paperboard band 44 to be removed.

In practice, a pharmacy serving a nursing home will place in the large chamber 22 of the loose dose dispenser 10 a desired amount of medication in loose form. There will be placed in the reserve chamber 24 a smaller amount of the same medication which will serve as a reserve supply. This reserve supply will be of a sufficient amount to fill the patient's needs while the prescription is being refilled. The pharmacist will also imprint a label with the required information and punch it out in accordance with the disclosure of my earlier patent. This label will then be placed on the rectangular band 44, the band 44 inserted around the dispenser 10 and with the locking tab 54 in locking position as shown in FIG. 6. The loose dose dispenser with the band 44 and the label thereon will then be sent to a nursing home. In dispensing the medication from the loose dose dispenser 10 the nurse will first use up the supply in the large chamber 22 by lifting up the pill dispensing flap 38 bearing the number 1 as shown in FIG. 1. When the supply of medication in the larger chamber 22 is exhausted the flap 46 is torn away and the nurse then uses the reserve supply of medication from the reserve chamber 24 by lifting up the flap numbered 2. In the meantime the prescription is being refilled, the nurse having reordered it when the need to use the reserve supply was discovered.

Having thus described my invention, I claim:

1. A reusable medication dispenser comprising a bottom part, said bottom part having a plurality of walls including sidewalls, a bottom wall and end walls, a divider wall extending between said end walls dividing said dispenser into two chambers, one of said chambers comprising a large chamber and the other a reserve chamber, said divider wall being positioned so that the large chamber is larger than the reserve chamber, said reserve chamber providing a chamber for a reserve supply of medication, said divider wall being nonparallel to the side walls and readily removable from the dispenser to permit clearing, and said divider wall being approximately as high as said side walls, a removable closure top which can cover said bottom part, said closure top having top and bottom surfaces, said upper surface having openings one of which overlies the reserve chamber and the other overlies the large chamber permitting medication contained in the large chamber to be dispensed until depleted and then dispensed from the reserve chamber, each opening being provided with a hinged flap, said bottom surface having a circumferential channel adapted to receive the side walls and end walls of said top part whereby said closure top is held securely in place.

2. The dispenser of claim 1 wherein a removable band surrounds the dispenser, said collar having color coded portions thereon, and a label overlying said color coded portion.

3. The dispenser of claim 2 wherein the band has a removable flap which overlies one of said flaps on the top part.

* * * * *